US010146166B2

(12) United States Patent
Takai

(10) Patent No.: US 10,146,166 B2
(45) Date of Patent: Dec. 4, 2018

(54) SHEET STORAGE CASSETTE AND IMAGE FORMING APPARATUS THEREWITH

(71) Applicant: KYOCERA Document Solutions Inc., Osaka (JP)

(72) Inventor: Hiroaki Takai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 44 days.

(21) Appl. No.: 15/436,467

(22) Filed: Feb. 17, 2017

(65) Prior Publication Data

US 2017/0277102 A1 Sep. 28, 2017

(30) Foreign Application Priority Data

Mar. 28, 2016 (JP) ..... 2016-064267

(51) Int. Cl.

| | |
|---|---|
| ***G03G 15/00*** | (2006.01) |
| ***B65H 1/04*** | (2006.01) |
| ***B65H 1/26*** | (2006.01) |
| ***G03G 21/16*** | (2006.01) |

(52) U.S. Cl.

CPC ..... *G03G 15/6502* (2013.01); *B65H 1/04* (2013.01); *B65H 1/266* (2013.01); *G03G 21/1647* (2013.01); *B65H 2402/64* (2013.01); *B65H 2405/121* (2013.01)

(58) Field of Classification Search

CPC ..... G03G 15/6502; G03G 2221/1654; G03G 2215/00713; B65H 2402/064; B65H 2405/121; E05B 65/0014

See application file for complete search history.

(56) References Cited

U.S. PATENT DOCUMENTS

| | | | | |
|---|---|---|---|---|
| 5,155,537 | A * | 10/1992 | Komatsu | B65H 1/04 271/9.02 |
| 8,770,577 | B2 | 7/2014 | Onodera | 271/164 |
| 2003/0048050 | A1* | 3/2003 | Wong | E05B 65/0014 312/333 |

(Continued)

FOREIGN PATENT DOCUMENTS

| | | | |
|---|---|---|---|
| JP | H 08-67475 | A | 3/1996 |
| JP | 2004-308389 | A | 11/2004 |
| JP | 2007-297170 | A | 11/2007 |

(Continued)

*Primary Examiner* — Jill E Culler
*Assistant Examiner* — Quang X Nguyen
(74) *Attorney, Agent, or Firm* — Stein IP, LLC

(57) ABSTRACT

A sheet storage cassette includes a cassette body, a cassette cover, and a lock mechanism. The lock mechanism includes a lock member swingably provided on a back-surface side of the cassette cover and engageable with a locking pin provided in the cassette insertion portion, and a biasing member biasing the lock member in a direction toward engagement with the locking pin. Along with an operation of inserting the cassette body into the cassette insertion portion, the lock member engages with the locking pin. In a state where the cassette body is inserted in the cassette insertion portion, by inserting a thin-plate shaped release member into a gap between the cassette cover and an exterior member arranged under and adjacent to the cassette cover, the lock member is caused to swing to release the engagement with the locking pin.

6 Claims, 6 Drawing Sheets

(56) References Cited

U.S. PATENT DOCUMENTS

| | | | | |
|---|---|---|---|---|
| 2007/0251405 | A1 | 11/2007 | Kurokawa et al. | 101/494 |
| 2013/0161902 | A1 | 6/2013 | Onodera | 271/264 |

FOREIGN PATENT DOCUMENTS

| | | | |
|---|---|---|---|
| JP | 2007-332658 | A | 12/2007 |
| JP | 2013-133214 | A | 7/2013 |
| TW | 188003 | | 7/1992 |

* cited by examiner

SHEET STORAGE CASSETTE AND IMAGE FORMING APPARATUS THEREWITH

INCORPORATION BY REFERENCE

This application is based upon and claims the benefit of priority from the corresponding Japanese Patent Application No. 2016-064267 filed on Mar. 28, 2016, the entire contents of which are incorporated herein by reference.

BACKGROUND

The present disclosure relates to a sheet storage cassette used to stock a large number of sheets of recording media in advance and an image forming apparatus provided with the same, and in particular, relates to a mechanism for locking a sheet storage cassette to a body of an image forming apparatus.

Sheet feeding cassettes (sheet storage cassettes) are used in image forming apparatuses, such as copiers, printers, and the like, for the purpose of feeding sheets of cut paper or the like. A sheet feeding cassette stocks a large number of unprinted sheets of paper, and feeds them one by one separately from the topmost layer of the sheets stacked inside the cassette, by means of a sheet feeding unit provided in the vicinity of the sheet feeding cassette.

By the way, sheets of paper stocked in a sheet feeding cassette inside an image forming apparatus can be stolen. To prevent such theft, there has been proposed an image forming apparatus provided with a sheet feeding cassette locking mechanism.

For example, there is known an image forming apparatus in which a lock for locking a sheet feeding cassette is arranged on the back side of a body frame, so that the design properties of the apparatus are not damaged and a thief is prevented from instantly finding out why he/she cannot draw out the sheet feeding cassette.

SUMMARY

According to a first aspect of the present disclosure, a sheet storage cassette includes a cassette body, a cassette cover, and a lock mechanism. The cassette body is insertable into and drawable out of a cassette insertion portion of a body of an image forming apparatus, and accommodates a sheet of recording medium. The cassette cover is provided on an upstream side of the cassette body with respect to a cassette body insertion direction, and constitutes a part of an exterior member of the image forming apparatus. The lock mechanism keeps the cassette body locked in a state of being inserted in the cassette insertion portion. The lock mechanism includes a lock member which is swingably provided on a back-surface side of the cassette cover, and engageable with a locking pin provided in the cassette insertion portion, and a biasing member which biases the lock member in a direction toward engagement with the locking pin. Along with an operation of inserting the cassette body into the cassette insertion portion, the lock member is brought into engagement with the locking pin by biasing force of the biasing member. In a state where the cassette body is inserted in the cassette insertion portion, by inserting a release member having a thin-plate shape into a gap between the cassette cover and the exterior member arranged under and adjacent to the cassette cover, the lock member is caused to swing against the biasing force of the biasing member, and the engagement of the lock member with the locking pin is released.

Further features and specific advantages of the present disclosure will become apparent from the following descriptions of preferred embodiments.

DETAILED DESCRIPTION

Figure 1:
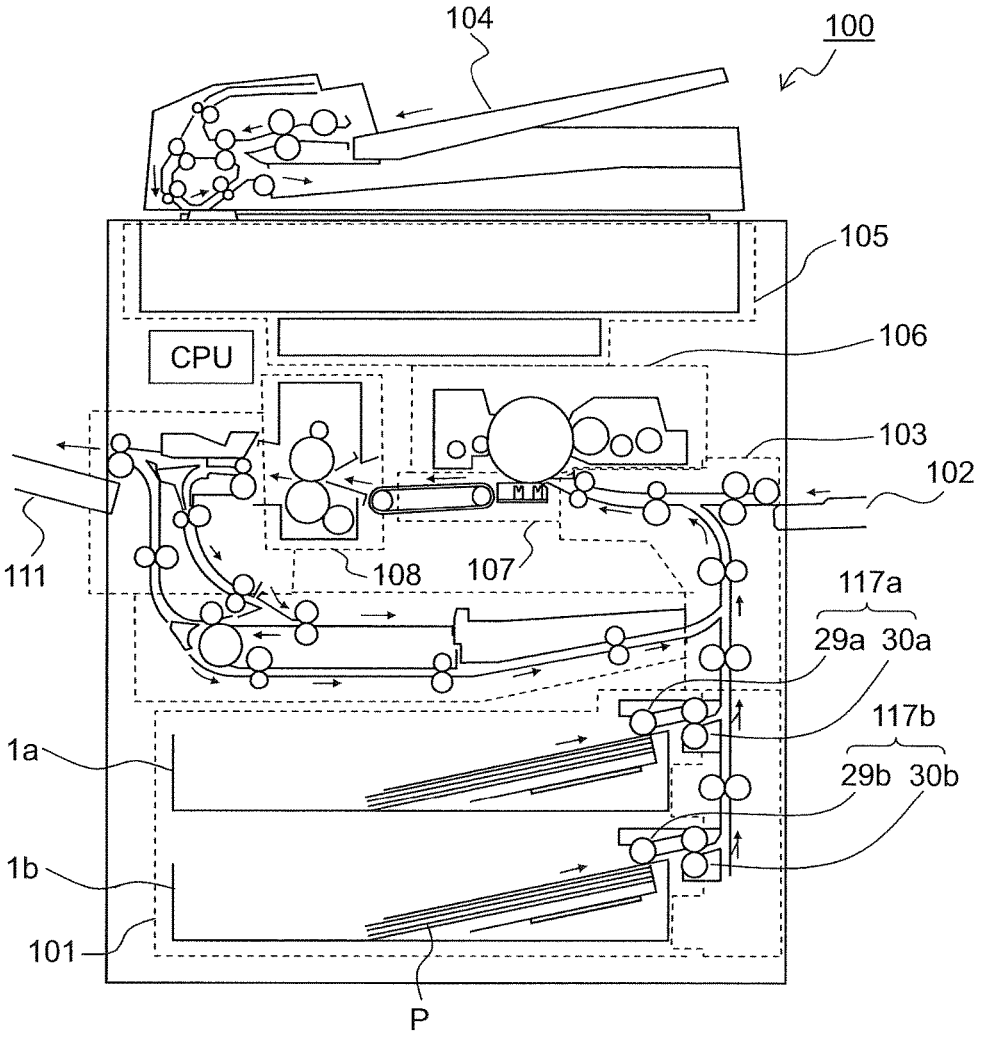
FIG. 1 is a side sectional view illustrating an internal configuration of an image forming apparatus according to an embodiment of the present disclosure.

Hereinafter, embodiments of the present disclosure will be described in detail with reference to the accompanying drawings. FIG. 1 is a side sectional view illustrating an internal configuration of an image forming apparatus 100 according to an embodiment of the present disclosure. In the figure, solid-line arrows indicate a sheet conveyance passage and a sheet conveyance direction.

In FIG. 1, in a lower part of the image forming apparatus 100, there is arranged a cassette-type sheet feeding portion 101. The cassette-type sheet feeding portion 101 is provided with two sheet feeding cassettes 1*a*, 1*b*. Inside these sheet feeding cassettes 1*a*, 1*b*, sheets P such as sheets of unprinted cut paper are accommodated in a stacked state, and the sheets P are fed out one by one separately from the stacked sheets P by sheet feeding units 117*a*, 117*b*, which are provided in a body of the image forming apparatus 100. The sheet feeding unit 117*a* includes a pickup roller 29*a* and a sheet feeding roller pair 30*a* both provided corresponding to the sheet feeding cassette 1*a*. The sheet feeding unit 117*b* includes a pickup roller 29*b* and a sheet feeding roller pair 30*b* both provided corresponding to the sheet feeding cassette 1*b*.

A manual sheet feeding portion 102 is provided outside an upper part of a right side surface of the image forming apparatus 100. The manual sheet feeding portion 102 is for placing thereon sheets P different in size and thickness from those in the cassette-type sheet feeding portion 101, and printing media to be fed in one by one, such as OHP sheets, envelopes, postcards, and invoices.

Inside the image forming apparatus 100, there is arranged a sheet conveyance portion 103. The sheet conveyance portion 103 is located on a downstream side of the cassette-type sheet feeding portion 101 with respect to a sheet feeding direction, that is, on a right side with respect to the cassette-type sheet feeding portion 101, and is located on the downstream side of the manual sheet feeding portion 102 with respect to the sheet feeding direction, that is, on a left side with respect to the manual sheet feeding direction. A sheet P fed out from the cassette-type sheet feeding portion 101 is conveyed vertically upward along a side surface of the body of the image forming apparatus 100 by the sheet conveyance portion 103, and a sheet P fed out from the manual sheet feeding portion 102 is conveyed horizontally.

On an upper surface of the image forming apparatus 100, there is arranged an auto document feeder 104, under which an image reading portion 105 is arranged. For document copying, a user places a plurality of document sheets on the auto document feeder 104. The auto document feeder 104 feeds out the document sheets one by one separately, and the image reading portion 105 reads image data from them.

On the downstream side of the sheet conveyance portion 103 with respect to the sheet feeding direction, under the image reading portion 105, an image forming portion 106 and a transfer portion 107 are arranged. At the image forming portion 106, an electrostatic latent image is formed based on the image data read by the image reading portion 105, and the electrostatic latent image is developed to form a toner image. Meanwhile, in synchronism with the formation of the toner image at the image forming portion 106, a sheet P is conveyed from the cassette-type sheet feeding portion 101 through the sheet conveyance portion 103 to the transfer portion 107. The toner image formed at the image forming portion 106 is transferred onto the sheet P at the transfer portion 107.

On the downstream side of the transfer portion 107, a fixing portion 108 is arranged. The sheet P onto which the toner image has been transferred at the transfer portion 107 is conveyed to the fixing portion 108, and passes through a nip between a fixing roller pair composed of a heating roller and a pressing roller. The toner image on the sheet P is thereby fixed to form a permanent image. The sheet P discharged from the fixing portion 108 is ejected onto a sheet ejection tray 111 provided outside a left side surface of the image forming apparatus 100.

Figure 2:
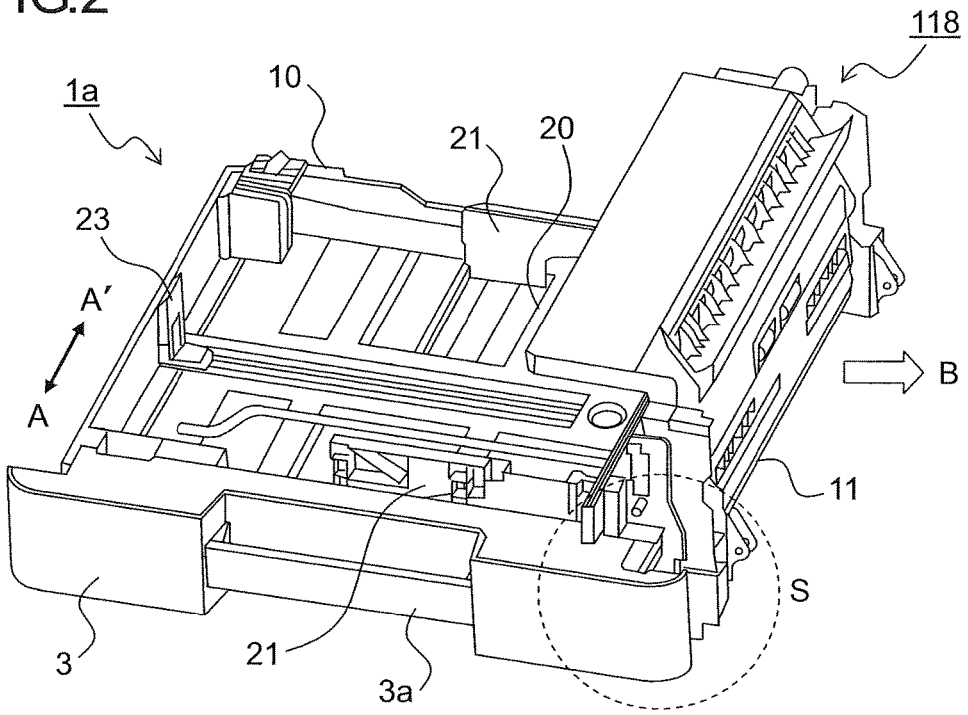
FIG. 2 is a perspective view of a sheet feeding cassette and a sheet feeding unit mounted in the image forming apparatus of the present embodiment as seen from front above.

Next a description will be given of details of a configuration of the sheet feeding cassette 1*a*, which is attachably and detachably used in the image forming apparatus 100, with reference to FIG. 2 in addition to FIG. 1. FIG. 2 is a perspective exterior view, as seen from an upper-front side, of the sheet feeding cassette 1*a* and a unit support frame 118. Here, the description will deal with the configuration of the sheet feeding cassette 1*a*, and the sheet feeding cassette 1*b* has completely the same configuration as the sheet feeding cassette 1*a*.

The sheet feeding cassette 1*a* illustrated in FIG. 2 is accommodated in the cassette-type sheet feeding portion 101 of the image forming apparatus 100 illustrated in FIG. 1. A cassette body 10 is formed in a shape of a flat box with an open top, having four walls standing upright along four edges of a bottom, and accommodates sheets P stacked in it from above (see FIG. 1). Outside a wall positioned on the downstream side with respect to the sheet feeding direction (right side in FIG. 2) inside the image forming apparatus 100, above the sheet feeding cassette 1*a*, there is arranged a unit support frame 118, which is included in the cassette-type sheet feeding portion 101. Sheets P are separated one by one from the stacked sheets P to be fed out in a direction indicated by an arrow B in FIG. 2 by the sheet feeding unit 117*a* (see FIG. 1) supported by the unit support frame 118. On a front face (on an upstream side with respect to an insertion direction) of the cassette body 10, a cassette cover 3 is formed integrally, and the cassette cover 3 forms a lower-front part of a housing of the image forming apparatus 100. In a center part of the cassette cover 3, there is provided a handle 3*a* which is to be held by the user to detach/attach the sheet feeding cassette 1*a*.

A pair of guide rails 11 are attached outside a wall extending in a direction parallel to a direction in which the sheet feeding cassette 1*a* is inserted or drawn out (AA' direction). The body of the image forming apparatus 100 is provided with a pair of rail support portions (not shown) slidably supporting the guide rails 11. By sliding the guide rails 11 along the rail support portions, the sheet feeding cassette 1*a* can be inserted into and drawn out of the image forming apparatus 100.

Inside the bottom of the cassette body 10, there are provided a sheet stacking plate 20 on which to stack sheets P and a pair of width restricting cursors 21 standing upright and extending along the sheet feeding direction (the direction indicated by the arrow B). The width restricting cursors 21 make contact with side faces of the stack of sheets from opposite sides in a sheet width direction (the AA' direction) perpendicular to the sheet feeding direction, and serve to position the sheets P in the sheet width direction to keep them in the sheet feed position from which the sheet feeding unit 117*a* feeds them out. The width restricting cursors 21 are movable along a cursor movement groove (not shown) which is provided in an inner surface of the bottom of the cassette body 10 so as to extend in the sheet width direction. The pair of width restricting cursors 21, which makes contact with side faces of the stack of sheets P from opposite sides in the sheet width direction, is configured in such a manner that, when one width restricting cursor moves, the other width restricting cursor is caused to move together by an action of an unillustrated interlocking mechanism provided under them. Here, the movement of the pair of width restricting cursors 21 is symmetric with respect to a width-direction center line of the sheets P.

Inside the cassette body 10, in an upstream-side part of the cassette body 10 with respect to the sheet feeding direction, a trailing-end restricting cursor 23 is provided. The trailing-end restricting cursor 23 makes contact with a side face of the stack of sheets P from the upstream side with respect to the sheet feeding direction, and serves to position the sheets in the sheet feeding direction (the direction indicated by the arrow B in FIG. 2) to keep them in the sheet feed position from which the sheet feeding device 117 feeds them out. The trailing-end restricting cursor 23 is movable along a cursor movement groove (not shown) that is provided in the inner surface of the bottom of the cassette body 10 so as to extend in the sheet feeding direction.

Figure 3:
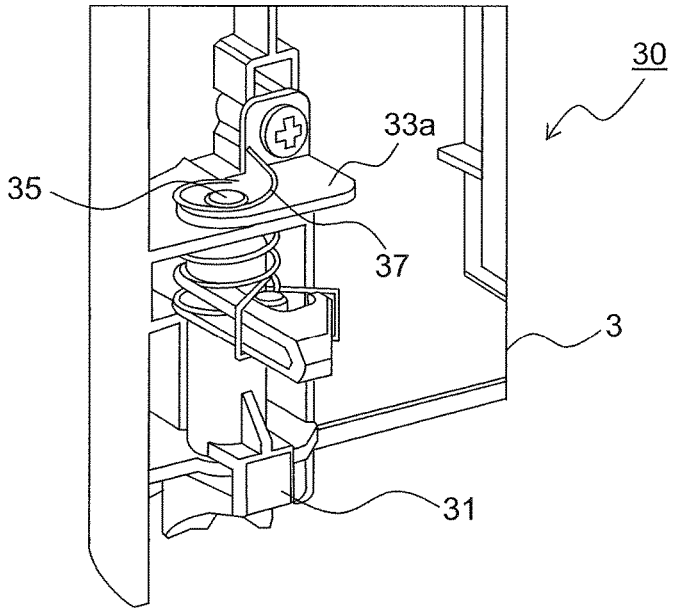
FIG. 3 is a perspective partial view illustrating a configuration of, and around, a lock member provided on one end (indicated by a broken-line circle in FIG. 2) of a back surface side of a cassette cover.
Figure 4:
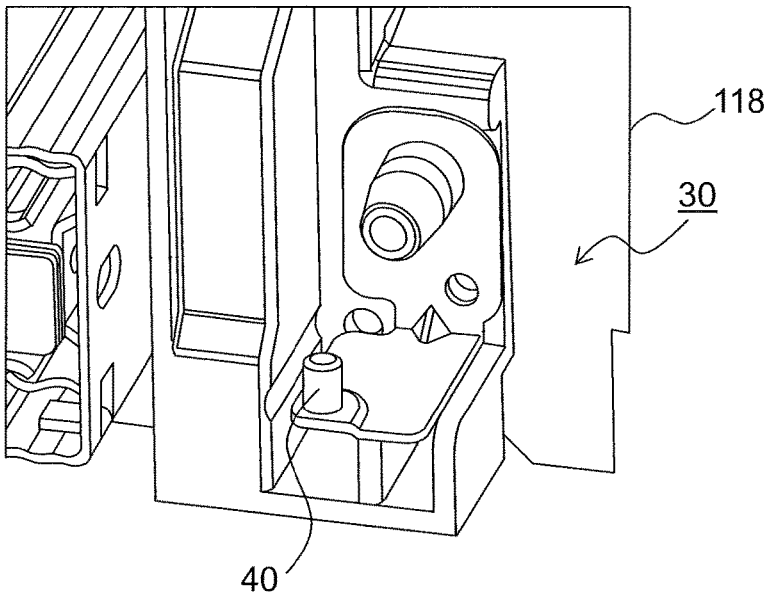
FIG. 4 is an enlarged perspective view of a locking pin provided in a unit support frame of a body of the image forming apparatus.
Figure 5:
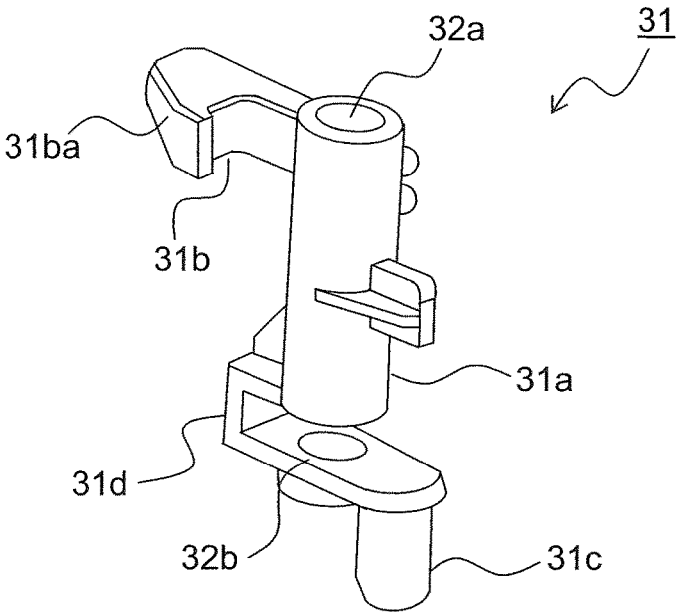
FIG. 5 is a perspective view of the lock member.
Figure 6:
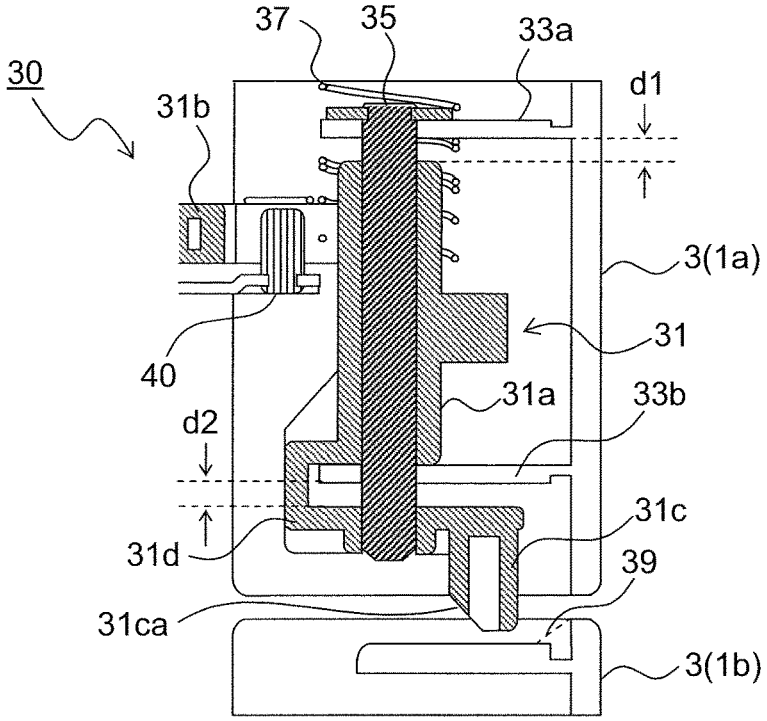
FIG. 6 is a side sectional view of a lock mechanism in a state where the sheet feeding cassette is inserted in a cassette-type sheet feeding portion.

The image forming apparatus 100 is provided with a lock mechanism 30 for locking the sheet feeding cassette 1*a* to the cassette-type sheet feeding portion 101 (see FIG. 1). Hereinafter, the lock mechanism 30 will be described in detail. FIG. 3 is a perspective view of, and around, a lock member 31 disposed at one end (indicated by a broken-line circle S in FIG. 2) of a back-surface side of the cassette cover 3. FIG. 4 is an enlarged perspective view of a locking pin 40 provided in the unit support frame 118 (on the cassette-type sheet feeding portion 101 side). FIG. 5 is a perspective view of the lock member 31. FIG. 6 is a side sectional view of the lock mechanism 30 in a state where the sheet feeding cassette 1*a* is inserted in the cassette-type sheet feeding portion 101.

The lock member 31 is attached to one end of the cassette cover 3, on the back-surface side of the cassette cover 3. The lock member 31 is swingably supported by a shaft 35, which is fixed to support portions 33*a* and 33*b* of the cassette cover 3. As illustrated in FIG. 5, the lock member 31 includes a cylindrical body portion 31*a* having a first through hole 32*a* through which the shaft 35 is to be inserted, a hook portion 31*b* protruding from an upper end of the body portion 31*a* in a diameter direction, a press portion 31*c* which protrudes from a lower end of the body portion 31*a* in a direction opposite to the direction in which the hook portion 31*b* protrudes and which is bent downward, and a crank portion 31*d* which is U-shaped in side view and via which the body portion 31*a* and the press portion 31*c* are connected to each other. The crank portion 31*d* includes a second through hole 32*b* which is formed coaxial with respect to the first through hole 32*a* of the body portion 31*a*.

As illustrated in FIG. 6, the body portion 31*a* of the lock member 31 is slidably supported by the shaft 35, in a state of being located between the support portions 33*a* and 33*b* in an up-down direction. The crank portion 31*d* is arranged avoiding an end of the support portion 33*b*. A lower end part of the shaft 35, which protrudes downward from the support portion 33*b*, is inserted through the second through hole 32*b* of the crank portion 31*d*. A distance d1 from an upper end part of the body portion 31*a* to a lower surface of the support portion 33*a* is substantially equal to a distance d2 from an upper surface of the crank portion 31*d* to a lower surface of the support portion 33*b*. This allows the lock member 31 to move in the up-down direction by the distance d1 (d2) along the shaft 35.

Further, a coil spring 37 is wound around the lock member 31, with one end of the coil spring 37 fixed to the lock member 31, and with the other end of the coil spring 37 fixed to the support portion 33*a*. The lock member 31 is biased by the coil spring 37 in a constant direction (counterclockwise direction in FIG. 3).

As illustrated in FIG. 4, the unit support frame 118 is provided with a locking pin 40, with which the hook portion 31*b* of the lock member 31 can engage. The lock member 31, the shaft 35, the coil spring 37, and the locking pin 40 constitute the lock mechanism 30 of the present disclosure.

Next, a description will be given of a procedure of locking the sheet feeding cassette 1*a* by means of the lock mechanism 30 and procedure of releasing the lock. When the sheet feeding cassette 1*a* is pushed into the cassette-type sheet feeding portion 101, the hook portion 31*b*, which is arranged on the rear surface side of the cassette cover 3, approaches the locking pin 40. Then, a first inclined portion 31*ba* (see FIG. 5) formed on an outer side of the hook portion 31*b* makes contact with the locking pin 40.

When the sheet feeding cassette 1*a* is pushed further into the cassette-type sheet feeding portion 101, the inclined portion 31*ba* is pressed by the locking pin 40, and this causes the lock member 31 to swing in the clockwise direction in FIG. 3. Then, when an upstream-side end part of the inclined portion 31*ba* with respect to the insertion direction passes the locking pin 40, the pressing force applied to the inclined portion 31*ba* disappears. As a result, the lock member 31 is caused to swing in the counterclockwise direction in FIG. 3 by the biasing force of the coil spring 37, to be arranged in a position (engagement position) where the hook portion 31*b* engages with the locking pin 40. Thereby, the sheet feeding cassette 1*a* is locked in the inserted state, and drawing of the sheet feeding cassette 1*a* out of the cassette-type sheet feeding portion 101 is restricted.

The coil spring 37 biases the lock member 31 in a downward direction as well, and as illustrated in FIG. 6, a lower end part of the press portion 31*c* is arranged below an upper end part of the cassette cover 3 of the sheet feeding cassette 1*b*, which is arranged under the sheet feeding cassette 1*a*. In the press portion 31*c*, a second inclined portion 31*ca* is formed on a side surface on the downstream side with respect to the insertion direction of the sheet feeding cassette 1*a*. When the sheet feeding cassette 1*a* is inserted, the press portion 31*c* moves onto the cassette cover 3 of the sheet feeding cassette 1*b* along the second inclined portion 31*ca*, and thereby the lock member 31 is caused to move upward against the biasing force of the coil spring 37. This makes it possible to avoid interference between the lock member 31 and the sheet feeding cassette 1*b* which would otherwise be caused in the insertion of the sheet feeding cassette 1*a*.

Figure 7:
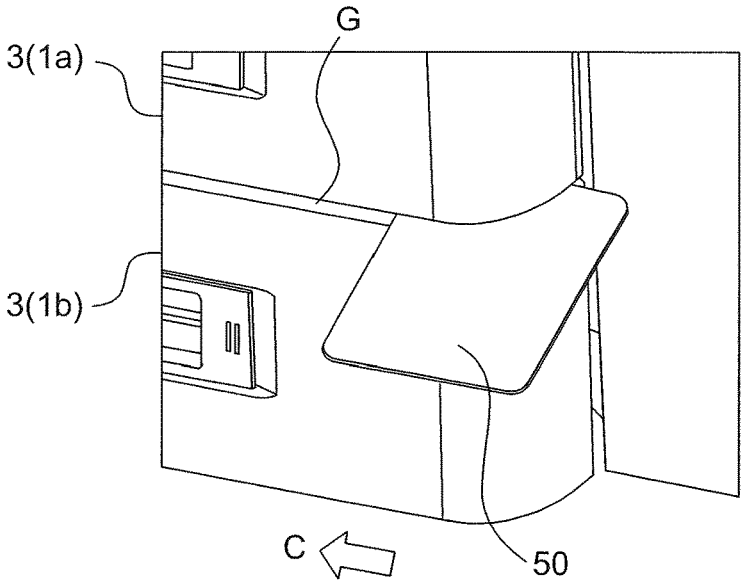
FIG. 7 is a perspective partial view illustrating a state where a release member is inserted in a gap between the cassette cover of the sheet feeding cassettes and the cassette cover of another sheet feeding cassette.

To draw the sheet feeding cassette 1*a* out of the cassette-type sheet feeding portion 101, as illustrated in FIG. 7, a release member 50, which is card-shaped (thin plate-shaped), is inserted into a gap G between the cassette cover 3 of the sheet feeding cassette 1*a* and the cassette cover 3 of the sheet feeding cassette 1*b*, at one end side (right end side in FIG. 2) of the cassette covers 3 where the lock mechanism 30 is provided. The release member 50 is not a dedicated member for releasing the lock mechanism 30, and various cards insertable into the gap G, such as an employee ID card and an IC card, can be used as the release member 50.

Figure 8:
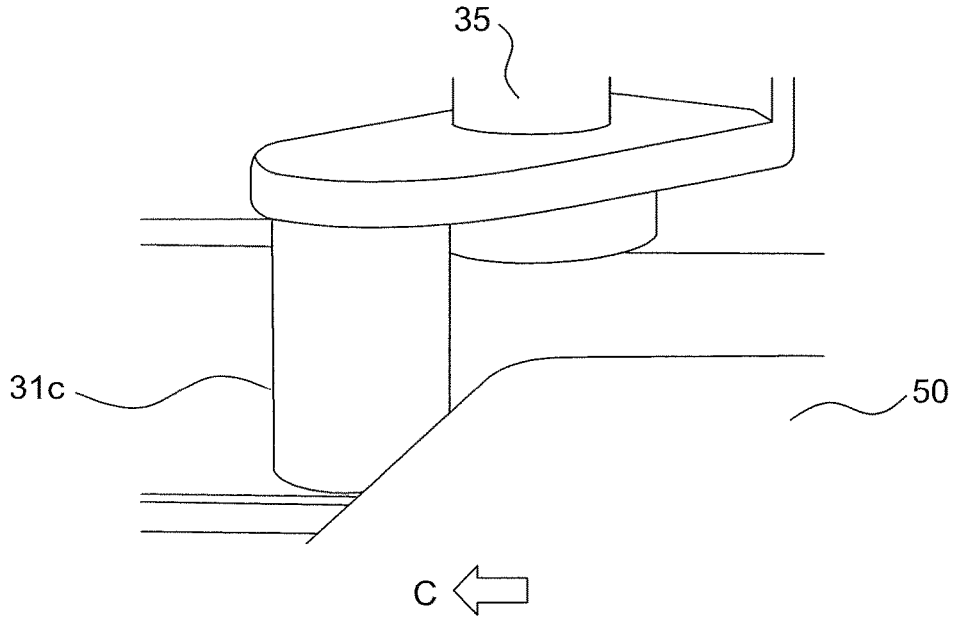
FIG. 8 is an enlarged view illustrating how an edge of the release member presses a press portion.
Figure 9:
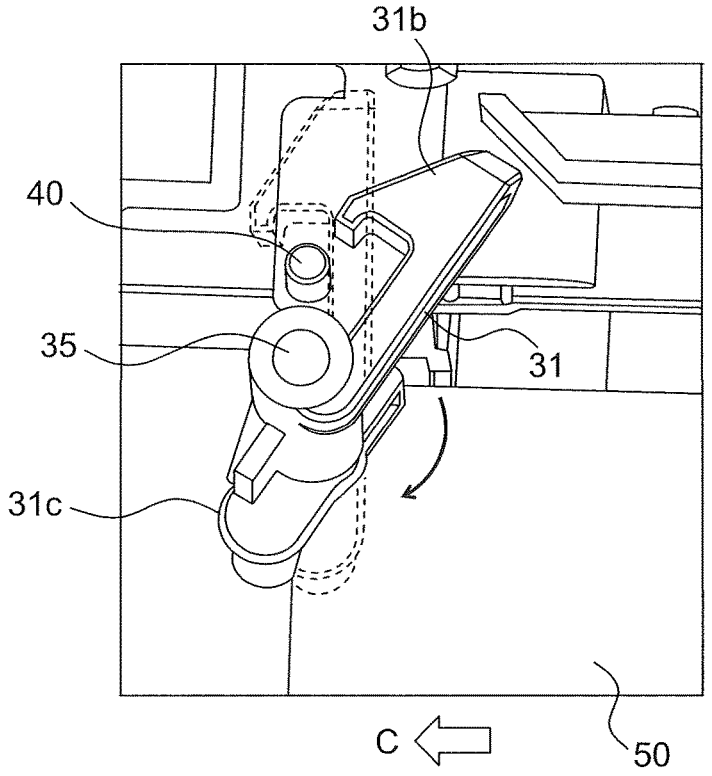
FIG. 9 is a plan view illustrating how the lock member swings about a shaft when the release member is inserted.

Then, the release member 50 is slid in a direction indicated by an arrow C, so that an edge of the release member 50 pushes the press portion 31*c* in the direction indicated by the arrow C as illustrated in FIG. 8. As a result, as illustrated in FIG. 9, the lock member 31 swings about the shaft 35 in the clockwise direction from the engagement position (indicated by broken lines) to be arranged in a release position (indicated by solid lines) where the engagement of the hook portion 31*b* with the locking pin 40 is released.

Figure 10:
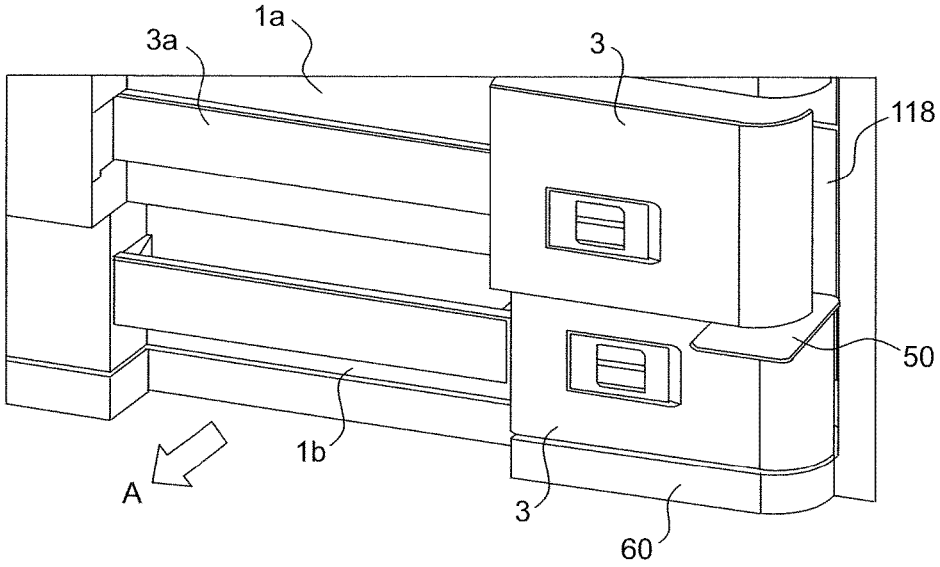
FIG. 10 is a perspective view illustrating how an operation of drawing out the sheet feeding cassette is performed with the release member in an inserted state.

In this state, as illustrated in FIG. 10, by holding the handle 3*a* and applying force to the sheet feeding cassette 1*a* in a direction indicated by an arrow A, it is possible to draw the sheet feeding cassette 1*a* out of the cassette-type sheet feeding portion 101.

Further, in the cassette cover 3 of the sheet feeding cassette 1*b*, there is formed an inclined surface 39, and the press portion 31*c* makes contact with the inclined surface 39 when the sheet feeding cassette 1*a* is drawn out. At the time of drawing out the sheet feeding cassette 1*a*, the press portion 31*c* moves onto the cassette cover 3 of the sheet feeding cassette 1*b* along the inclined surface 39, and this causes the lock member 31 to move upward against the biasing force of the coil spring 37. Thereby, it is possible to avoid interference between the lock member 31 and the sheet feeding cassette 1*b* which would otherwise be caused in the drawing-out of the sheet feeding cassette 1*a*.

With the configuration of the present embodiment, since the drawing-out of the sheet feeding cassette 1*a* is restricted (locked) just by inserting the sheet feeding cassette 1*a* into the cassette-type sheet feeding portion 101, there is no need of providing a lock or the like for locking the sheet feeding cassette 1*a*, and thus no locking operation is necessary. Furthermore, the release member 50 for releasing the lock to draw out the sheet feeding cassette 1*a* may be any card-shaped member insertable into the gap G, and thus no dedicated key is necessary. Thus, the sheet feeding cassette

1*a* can be drawn out just by inserting a card-shaped member into the gap G, and this contributes to improved user-friendliness.

Since the lock mechanism 30 is externally invisible and difficult for those other than the user to notice, there is no risk of the sheet feeding cassette 1*a* being drawn out by a thief. Furthermore, the design properties of the image forming apparatus 100 are improved without any risk of damage to the appearance of the image forming apparatus 100.

The lock member 31 is also biased in the downward direction by the coil spring 37, and in the state where the sheet feeding cassette 1*a* is inserted in the cassette-type sheet feeding portion 101, the press portion 31*c* extends to a position below an upper surface of the cassette cover 3 of the sheet feeding cassette 1*b*. Thereby, it is possible to securely make an edge of the release member 50 make contact with the press portion 31*c* when the release member 50 is inserted through the gap G.

By providing the second inclined portion 31*ca* in the press portion 31*c* of the lock member 31 and providing the inclined surface 39 in the cassette cover 3 of the sheet feeding cassette 1*b*, it is possible to avoid interference between the press portion 31*c* and the cassette cover 3 of the sheet feeding cassette 1*b* at the time of inserting or drawing-out of the sheet feeding cassette 1*a*, and this contributes to smooth insertion and drawing-out of the sheet feeding cassette 1*a*.

In the present embodiment, the description has dealt with the lock mechanism 30 of the sheet feeding cassette 1*a*, but a lock mechanism 30 may be provided in the sheet feeding cassette 1*b*, too. In that case, the lock mechanism 30 may be released by inserting the release member 50 into a gap between the cassette cover 3 of the sheet feeding cassette 1*b* and an external cover 60 located under the cassette cover 3. Further, by forming an inclined surface 39 in the exterior cover 60, it is possible to avoid interference between the lock member 31 and the exterior cover 60 which would otherwise be caused when the sheet feeding cassette 1*b* is drawn out.

It should be understood that the present disclosure is not limited to the above embodiments, and various modifications are possible within the scope of the present disclosure. For example, without being limited to the image forming apparatus 100 shown in FIG. 1, which includes the two sheet feeding cassettes 1*a* and 1*b*, the present disclosure is also applicable to image forming apparatuses including only one sheet feeding cassette, or to image forming apparatuses including three or more sheet feeding cassettes.

Further, the present disclosure is not limited to a monochrome copier as illustrated in FIG. 1, and applicable to various image forming apparatuses, such as monochrome and color printers, color copiers, and facsimile machines, which are provided with a sheet feeding cassette.

The present disclosure can be used in image forming apparatuses provided with a sheet storage cassette attached in such a manner that it can be inserted into and drawn out of the image forming apparatuses. Usage of the present disclosure makes it possible to lock a sheet storage cassette with a simple configuration without using a dedicated key, and also to provide an image forming apparatus where an operation to release the locking of the sheet storage cassette is difficult to be found out.

What is claimed is:

1. A sheet storage cassette comprising:

a cassette body which is insertable into and drawable out of a cassette insertion portion of a body of an image forming apparatus, and accommodates a sheet of recording medium;

a cassette cover provided on an upstream side of the cassette body with respect to a cassette body insertion direction, and constitutes a part of an exterior member of the image forming apparatus; and a lock mechanism which keeps the cassette body locked in a state of being inserted in the cassette insertion portion, wherein the lock mechanism includes a lock member which is swingably provided on a back-surface side of the cassette cover, and engageable with a locking pin provided in the cassette insertion portion, and a biasing member which biases the lock member in a direction toward engagement with the locking pin, along with an operation of inserting the cassette body into the cassette insertion portion, the lock member is brought into engagement with the locking pin by biasing force of the biasing member, and in a state where the cassette body is inserted in the cassette insertion portion, by inserting a release member having a thin-plate shape into a gap between the cassette cover and the exterior member arranged under and adjacent to the cassette cover, the lock member is caused to swing against the biasing force of the biasing member, and the engagement of the lock member with the locking pin is released, wherein the lock member includes a body portion which has a cylindrical shape and in which a shaft fixed to the cassette cover is inserted, a hook portion protruding from an upper part of the body portion in a diameter direction and engageable with the locking pin, and a press portion which protrudes from a lower part of the body portion in a direction opposite to the direction in which the hook portion protrudes, the press portion being bent downward, the lock member being swingable about the shaft in a horizontal direction, in a state where the sheet storage cassette is inserted in the cassette insertion portion, the lock member is biased by the biasing force of the biasing member to be arranged in an engagement position where the hook portion engages with the locking pin, by the press portion being pressed by the release member inserted into the gap, the lock member is caused to swing against the biasing force of the biasing member into a release position where the engagement of the hook portion with the locking pin is released.

2. The sheet storage cassette according to claim 1, wherein the hook portion includes a first inclined portion formed on a part thereof that makes contact with the locking pin when the sheet storage cassette is inserted into the cassette insertion portion.

3. The sheet storage cassette according to claim 1, wherein the lock member is movable in an up-down direction along the shaft, and the biasing member biases the lock member in a downward direction, and along with the operation of inserting the cassette body into the cassette insertion portion, the lock member climbs over an upper end part of the exterior member while moving upward against the biasing force of the biasing member, and in a state where the sheet storage cassette is inserted in the cassette insertion portion, a lower end part of the press portion is arranged below the upper end part of the exterior member.

4. The sheet storage cassette according to claim 3, wherein the press portion includes a second inclined portion formed on a part thereof that makes contact with the upper end part of the exterior member when the sheet storage cassette is inserted into the cassette insertion portion.

5. The sheet storage cassette according to claim 3, wherein the cassette cover includes an inclined surface formed on a part thereof that, when another sheet storage cassette arranged over and adjacent to the cassette cover is drawn out of the cassette insertion portion, makes contact with the press portion of the lock member provided in the other sheet storage cassette.

6. An image forming apparatus comprising the sheet storage cassette according to claim 1.

* * * * *